United States Patent [19]

Rashid et al.

[11] Patent Number: 4,485,148

[45] Date of Patent: Nov. 27, 1984

[54] CHROMIUM BORON SURFACED NICKEL-IRON BASE ALLOYS

[75] Inventors: James M. Rashid, Manchester; Leonard A. Friedrich; Melvin Freling, both of West Hartford, all of Conn.

[73] Assignee: United Technologies Corporation, Hartford, Conn.

[21] Appl. No.: 512,297

[22] Filed: Jul. 8, 1983

[51] Int. Cl.[3] ..... B32B 5/14

[52] U.S. Cl. ..... 428/610; 428/656; 428/666; 428/667

[58] Field of Search ..... 428/610, 627, 667, 680, 428/678, 685, 656, 666, 472; 427/250–253, 404, 405; 148/31.5

[56] References Cited

U.S. PATENT DOCUMENTS

| | | | |
|---|---|---|---|
| 3,029,162 | 4/1962 | Samuel et al. | 117/107 |
| 3,061,463 | 10/1962 | Samuel | 428/941 |
| 3,257,230 | 6/1966 | Wachtell et al. | 428/941 |
| 3,622,402 | 11/1971 | Baranow et al. | 148/6.35 |
| 3,664,765 | 5/1972 | Ishimatsu et al. | 428/941 |
| 3,712,798 | 1/1973 | Thyne et al. | 29/195 A |
| 3,779,719 | 12/1973 | Clark et al. | 29/197 |
| 3,935,034 | 1/1976 | Hayes | 148/6 |
| 4,148,936 | 4/1979 | Grisik et al. | 427/253 |

FOREIGN PATENT DOCUMENTS

| | | | |
|---|---|---|---|
| 56-81670 | 7/1981 | Japan | 428/667 |
| 637460 | 12/1978 | U.S.S.R. | 427/253 |
| 899709 | 1/1982 | U.S.S.R. | 427/252 |

OTHER PUBLICATIONS

Cubberly, W. H. et al., *Metals Handbook 9th Edition*, vol. 3, Am. Soc. for Metals; p. 5, (1980).

*Primary Examiner*—Michael L. Lewis
*Attorney, Agent, or Firm*—C. G. Nessler

[57] ABSTRACT

Chromium boron diffusion coatings on nickel iron alloys uniquely provide them with improvement in high cycle fatigue strength (up to 30%) and erosion resistance (up to 15 times), compared to uncoated alloy. The diffused chromium layer extends in two essential concentration zones to a total depth of about $40\times10^{-6}$ m, while the succeeding boron layer is limited to 50–90% of the depth of the richest Cr layer nearest the surface. Both coatings are applied using conventional pack diffusion processes.

5 Claims, 5 Drawing Figures

CHROMIUM BORON SURFACED NICKEL-IRON BASE ALLOYS

The invention described herein was made during the performance of work under NASA Contract NAS3-20072 and is subject to the provisions of Section 305 of the National Aeronautics and Space Act of 1958 (72 Statute 435; 42 USC 2457).

TECHNICAL FIELD

The present invention relates to diffusion coatings for improving the particulate erosion resistance of nickel-iron superalloys which are subjected to mechanical fatigue.

BACKGROUND

The compressor sections of axial flow gas turbine engines are subject to particulate erosion due to the ingestion of sand and like matter. Particulate erosion tends to particularly wear away portions of the airfoils which rotate at high speeds. These airfoils are made variously of alloys of titanium, iron and nickel, depending on the temperature which they must endure. The present invention has resulted from extensive work which sought to improve the resistance of airfoils to particulate erosion by imparting a hardened surface to them. In this work, as well as in other work of the prior art, a multiplicity of kinds of coatings have been evaluated, including overlay or deposited coatings which are laid down by plasma spraying, plating, etc. and diffusion coatings wherein elements are diffused into the surface of the article to alter its character.

The approach in the past, as well as that used in making the present invention, has been largely empirical since there is insufficient technology base to allow prediction of erosion behavior on the basis of microstructure or other properties normally measured and used in making material selection. Generally, the object was to provide a hard surface since a general correlation is observed between the hardness of the surface and its resistance to erosion, at least for materials which are potentially useful on metal airfoils operating at 250°-600° C.

The present invention is concerned with the diffusion type coatings, especially those which are comprised of chromium and boron. Generally, borides are known as hard compounds. Therefore, it is logical that boron diffusion into the surface of a structure provides a hard surface, and Hayes in U.S. Pat. No. 3,935,034 discloses boron diffusion into alloys of iron, nickel and cobalt, to provide a wear resistant surface. However, when concentrations of boron are high, there is brittleness at the surface of the material, and it is prone to cracking. Samuel et al in U.S. Pat. No. 3,029,162 discloses the use of a diffusion layer of chromium prior to boron diffusion. While Samuel et al infer the object of their invention is to obtain hardness without brittleness, no relevant data is present beyond hardness measurements. Baranow et al in U.S. Pat. No. 3,622,402 say that the Samuel et al process tends to improve the corrosion resistance of a boronized article, but it is disclosed that the process reduces the mechanical fatigue life of the material by about 50%. Baranow et al further state that simple boronizing of steels also reduces fatigue life by as much as 50%. Their improvement is that the parts are chromized after boronizing, and it is said that this provides at least 80% of the fatigue life which articles had prior to coating, thus providing an improvement over the prior art processes. Thyne et al in U.S. Pat. No. 3,712,798 discloses a method of providing a chromium boride layer on the surface of an article by first depositing an overlay of chromium. That is, instead of interdiffusing the chromium, it must be deposited as a distinct pure layer. Then, boron is diffused into the chromium layer in such a manner that there remains between the boron containing region and the substrate a layer of unadulterated chromium. It is said this provides corrosion resistance and enables a crack-free chromium boride layer on steels where there is a tendency for the layer to be cracked.

As is generally known in the aircraft industry and as mentioned in U.S. Pat. No. 3,622,402, providing a protective surface layer on an article reduces the fatigue strength of the article. This is especially true when the coatings are hard because often associated with the hardness is a low ductility. It is well known that fatigue cracks initiate at the surfaces of articles where the stresses are highest and where there is the greatest propensity for flaws. U.S. Pat. No. 3,779,719 to Clark et al discloses a predominately aluminum coating containing chromium and silicon, which it is said decreases thermal fatigue.

The present invention is particularly concerned with alloys which are used in the higher temperature sections of gas turbine engine compressors. Usually these alloys are called superalloys; other times they are referred to as high temperature alloys, since they have high temperature strength. Compressor parts are particularly prone to mechanical fatigue, which is described in more detail herein. It is well known that putting a coating, such as an electroplate on the surface of a material, will reduce its high cycle fatigue life. Further, boronizing a superalloy will also reduce its fatigue life, as has been reported for other materials. On the other hand, there are some coatings, such as metal-organic coatings, which will not substantially decrease fatigue life but neither will they provide a desired substantial increase in erosion resistance. Consequently, the object of the invention is to provide a coating to a high temperature alloy, which coating does not significantly decrease fatigue life and at the same time which coating substantially increases erosion resistance.

DISCLOSURE OF THE INVENTION

The invention comprises chromium boron coatings on iron nickel base alloys. By iron nickel base alloys is meant those containing by weight percent 25-45 Ni and 30-50 Fe. Chromium boron coatings applied to such alloys will maintain or increase their high cycle fatigue strength and will provide five times or more increase in particulate erosion resistance, compared to uncoated alloys. Such results are unique to the particular class of alloys, compared to materials which have been chromium boron surfaced in the past.

According to the invention, chromium is first diffused into the surface of the substrate to a first depth, preferably by using a pack chromizing process wherein the substrate is exposed to a temperature of 900°-1040° C. for 6-24 hours. This provides on the surface of the article a superenriched (>50%) chromium layer of about $20\times10^{-6}$ m depth and an enriched (greater than the base metal content but less than the super-enriched content) chromium layer to a depth of about $40\times10^{-6}$ m. Then boron is diffused, preferably by pack boronizing, into the chromium super-enriched layer so that the visual depth of boron penetration is 50–90 percent of the super-enriched layer depth. The boron should not equal or exceed the depth of the super-enriched chromium layer. Preferably, the Cr-B coated substrate is given a full heat treatment if the coating process tends to produce unwanted phases, as occurs in the exemplary alloy IN 901.

Nickel-iron alloys coated in accord with the foregoing have unique properties compared to iron base alloys similarly coated. Also, it was found that boron enriching a diffused Cr layer provided good erosion resistance whereas similarly enriching a Ti layer did not, even though fatigue life for both coatings was improved. Thus, the invention involves the criticality in coating composition and structure with respect to the essential composition of the substrate.

The foregoing and other objects, features and advantages of the present invention will become more apparent from the following description of preferred embodiments and accompanying drawings.

BEST MODE FOR CARRYING OUT THE INVENTION

The invention is described in terms of coating the nickel iron alloy IN 901, having a composition of 11–14 Cr, 40–45 Ni, 5–6.5 Mo, 2.6–3.1 Ti, 0.01–0.02 B, 0.02–0.08 C, remainder (~31–42) Fe. Typically Fe is about 35%. Cobalt may replace a portion of the Ni. The alloy is characterized variously as a nickel base and an iron base alloy. More properly it is classified as a nickel-iron base alloy as are some other materials where no element comprises more than 50%.

As a demonstration of the invention, wrought IN 901 (by weight percent, about 14 Cr, 43 Ni, 5 Mo, 3 Ti, 35 Fe, 0.015 B, 0.05 C) test specimens and blade specimens were coated with chromium first and then boron, using the following procedure. The IN 901 substrates were first cleaned in a conventional way and pack chromized by placing them in an argon filled retort in contact with a pack mixture comprised by weight of 50 Cr, 5 $NH_4Cl$, and 45 $Al_2O_3$. The parts were heated to 1040°±13° C. for 6 hr. The treatment produces chromium enrichment to about $35\times10^{-6}$ m depth, based on microprobe data shown in FIG. 2. The Cr content of the pack mixture is relatively high (compared to a more typical 25%) owing to the relatively low processing temperature, chosen to avoid possible grain growth in the IN 901 material, since such grain growth would decrease fatigue properties in the substrate IN 901. Generally, we kept grain size finer than ASTM No. 2.

Next the parts were placed in a boronizing pack mixture comprised by weight percent of 5 B, 1 $HN_4F$ and 94 $Al_2O_3$. The pack and encapsulated part were heated under argon to 870°±13° C. for 6 hr. The temperature was relatively low, to limit the rate of diffusion of boron into the chromized layer. The boron was diffused into the chromized layer to a depth of about $10\times10^{-6}$ m, based on visual observation like that shown in FIG. 1.

The parts are then heat treated in the conventional mode for the alloy or a variation thereof. Preferred is to solution treat at 970°–1040° C. for 1–2 hr., air cool; followed by stabilization at 700°–730° C. for 6–20 hr., air cool; followed by an age or precipitation at 635°–665° C. for 12–20 hr, air cool. The purpose of the heat treatment is to eliminate acicular eta phase which is caused by the prolonged thermal exposure during the coating process.

Figure 1:
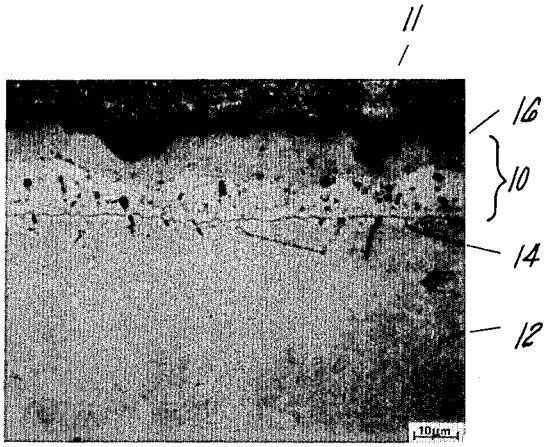
FIG. 1 is a photomicrograph of the cross section of a Cr-B coating on an IN 901 alloy substrate.

FIG. 1 shows a photomicrograph of the coating 10 (overcoated with nickel plate 11 for micro-mounting purposes) produced on an IN 901 substrate 12 using the foregoing procedure. The specimen was etched with aqueous ferric chloride reagant. There is a sharp visual demarcation 14 indicative of the depth of super-enrichment with Cr; this demarcation is used as the measure of the Cr layer coating thickness referred to herein, even through the Cr does actually extend further, as discussed in connection with FIG. 2. Similarly, the depth of boron penetration is indicated by the more gray appearing portion 16 near the coating surface. It is presumed that this structure is indicative of the presence of chromium borides, based on the hardness and erosion resistance of the surface.

Figure 2:
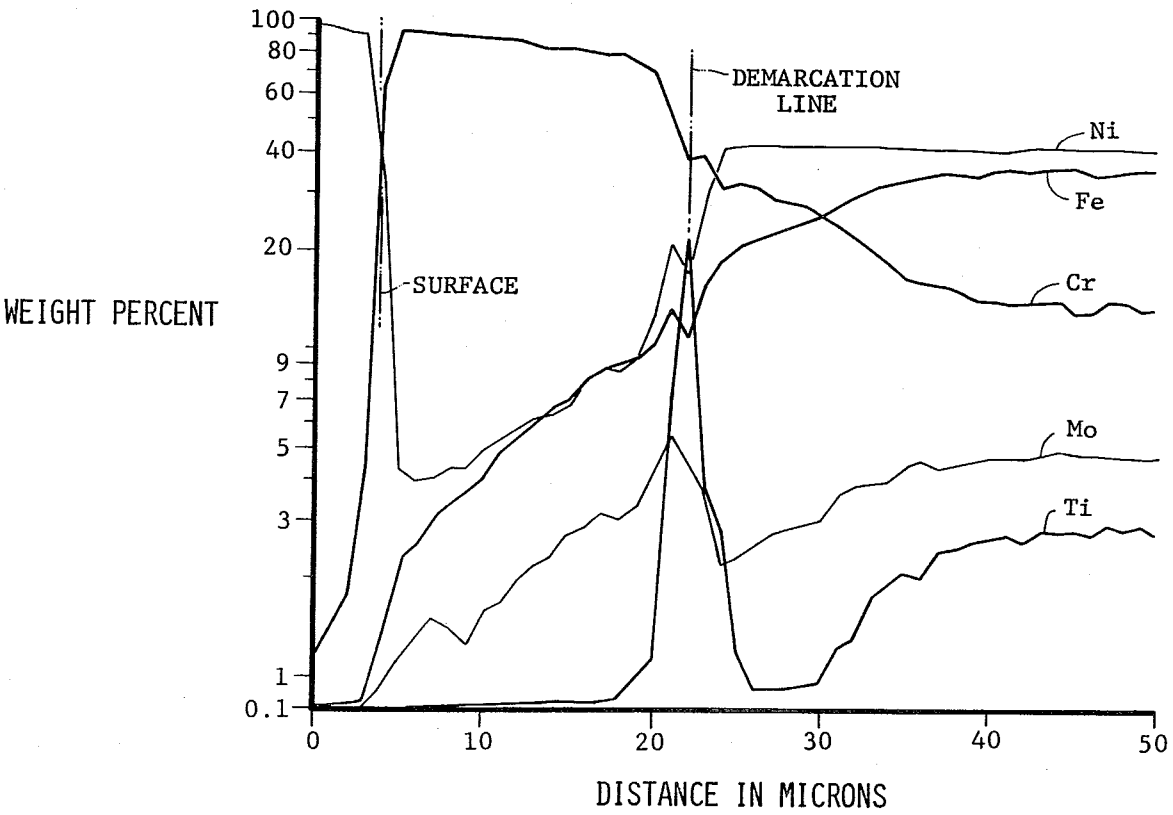
FIG. 2 shows the electron microprobe concentration gradient measurement across the thickness of a Cr-B coating on IN 901.

FIG. 2 shows the elemental concentration gradients in the coating after chromizing but before boronizing, as measured by electron microprobe. Correlation of the FIG. 2 data with the visual micrographic data of FIG. 1 shows that there is about 94 weight percent Cr near the surface and about 72 weight percent Cr at the demarcation line 14. The Cr drops sharply at the demarcation line and then gradually declines to basemetal level of about 14%. Experiments show that the boronizing treatment does not substantially alter the concentration of Cr, as measured by parameters referred to in connection with FIGS. 1 and 2.

Figure 3:
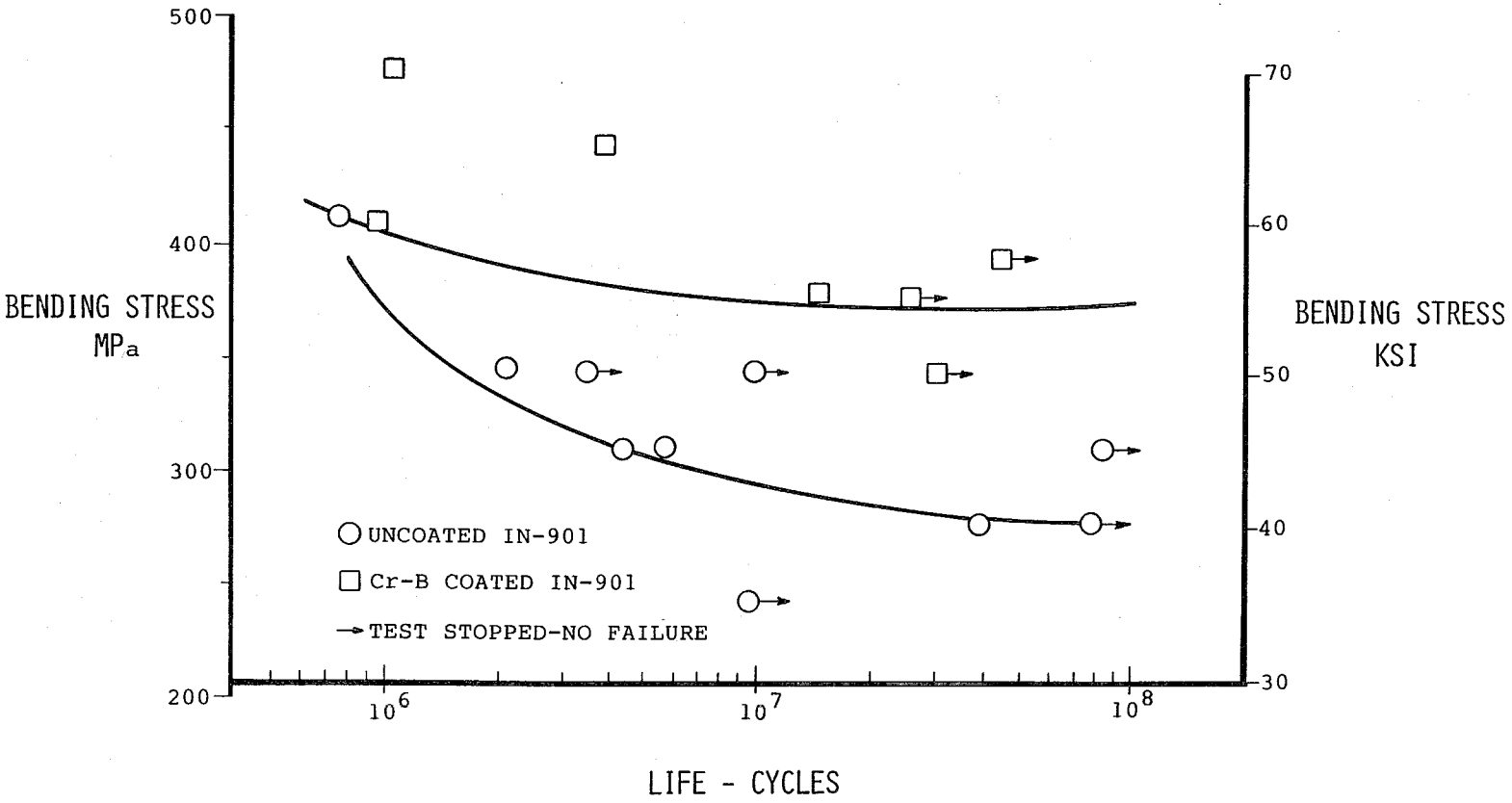
FIG. 3 shows the high cycle fatigue properties of IN 901 material having no coating and Cr-B coating.

The fatigue properties of coated IN 901 specimens were compared to uncoated material by Krouse reverse bending high cycle fatigue testing at $K_t=1$, 30 Hz and 25° C. High cycle fatigue is commonly defined as that mechanical fatigue which results in failures in $10^5$–$10^7$ cycles. Actual airfoils were also tested in the coated and uncoated conditions. The data in FIG. 3 are indicative of the comparative properties of uncoated IN 901 and IN 901 coated with Cr-B as described above. It is surprisingly seen that there is a substantial improvement in fatigue life for the coated material compared to the uncoated material. Typical baseline IN 901 fatigue stress for $10^7$ cycles runout is about 344 MPa and the chromium boron coated material had properties in excess of this, appearing to be at least 30% better. There will be inevitable variations in the chemistry and process of making the substrate and coating. Therefore, the 30% advantage may not always be obtained. But in the invention the fatigue strength of the coated substrate will be at least equal to that of the uncoated substrate, given the substantial effect we have realized.

Given these favorable results, the same surface treatment was applied to the iron base alloy known as Greek Ascoloy (AMS 5616 and other AMS specifications), which is a wrought material commonly used in gas turbine compressor blades having the essential composition by weight of 13 Cr, 2 Ni, 3 W, 0.17 C, balance Fe. However, as the following data indicates, the invention appears to be unique to nickel-iron base alloys.

Figure 4:
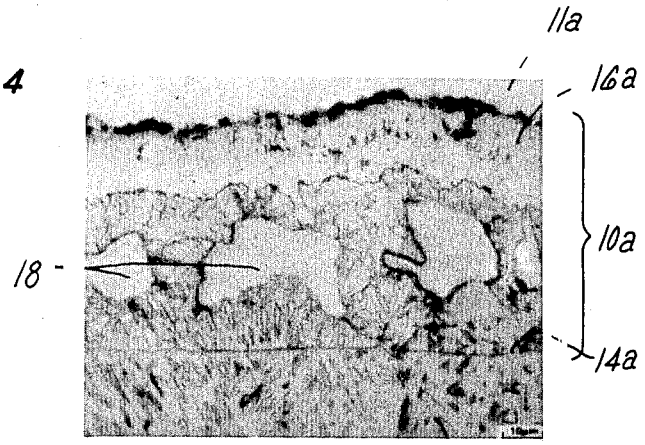
FIG. 4 is a photomicrograph of the cross section of a Cr-B coating on Greek Ascoloy steel.
Figure 5:
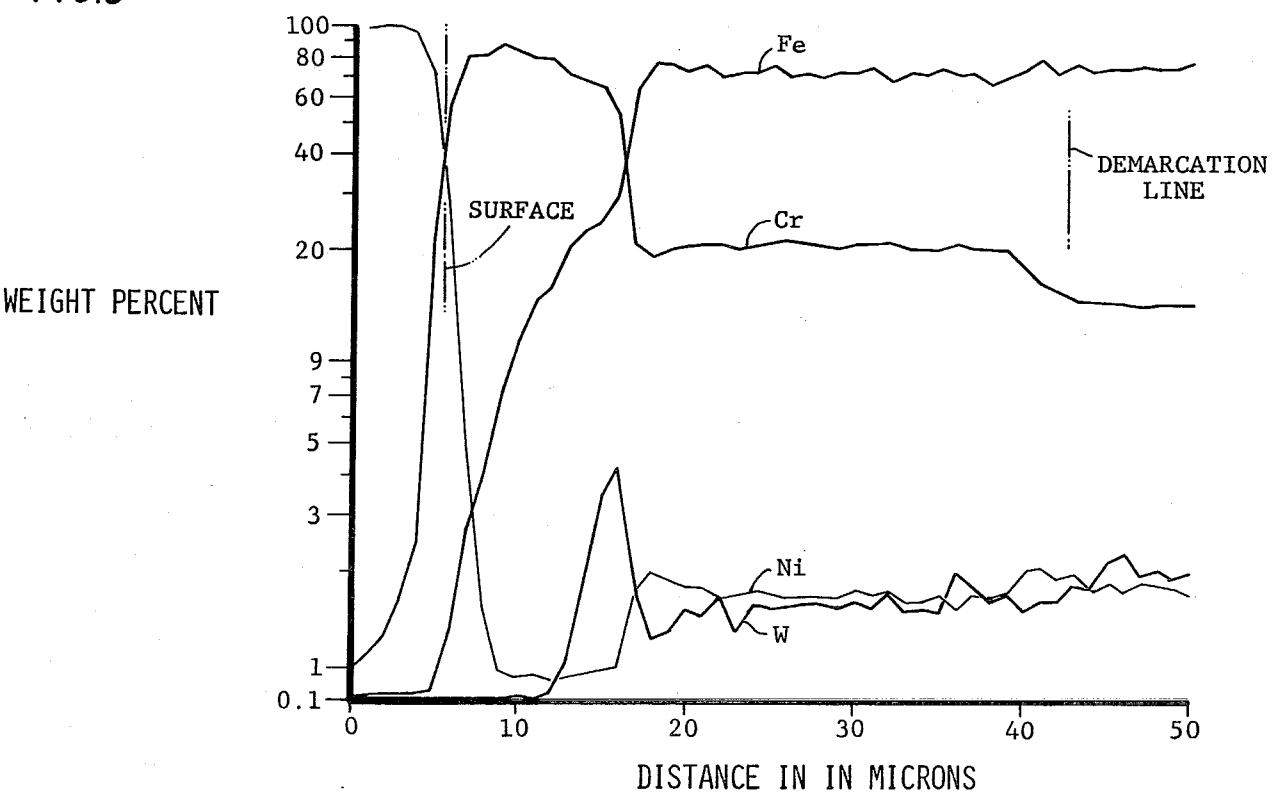
FIG. 5 is similar to FIG. 2, but for Cr-B on Greek Ascoloy.

FIG. 4 shows a microsection of the coating on AMS 5616 substrate prepared with Villela's Reagent, to reveal features similar to those shown in FIG. 1 for IN 901. It is seen first that the chromium of the coating 10a extends to a much greater depth in the substrate 12a, as indicated by the demarcation line 14a than does the chromium phase extend in the IN 901 alloy. Second, it is seen that the gray boronized region 16a is about the same as in IN 901. Third, it is seen that there are islands 18 of apparent precipitate, which electron microprobe analysis shows to be comprised of 22 Fe, 58 Cr, 12 W, and less than 1 Ni. FIG. 5 shows the microprobe-measured concentration of elements from the surface of the coating inward. There are two distinct levels of chromium, a super-enriched layer and an enriched layer of about 20 weight percent extending back to a depth of $40\times10^{-6}$ m. The demarcation line 14a in FIG. 4 corresponds with the region where the chromium content drops from about 20% to about the base metal level of 13%. When fatigue testing was conducted on the chromium-boron coated AMS 5616, the baseline fatigue strength of about 455 MPa was reduced to about 295 MPa, or a value only about 65% of the baseline value. This result correlates with the disclosure of Baranow et al U.S. Pat. No. 3,622,402.

Thus, it was concluded that (a) the morphology of the coating structure developed in the ironnickel base alloy was distinct from that developed in the iron base alloy, and (b) the iron-nickel base alloy was unique compared to the steel in that fatigue strength was increased rather than decreased. The steel behaved like materials of the prior art.

IN 901 substrate was also pack diffused with titanium and boronized using parameters like those for Cr-B to provide a Ti-B coating on the surface of parts. Examination and testing were similar to those for the Cr-B coatings. Microstructurally, the Ti-B coating was somewhat similar in depth of diffusion to the AMS 5616 specimen shown in FIG. 4, except that a multiplicity of finer acicular phases replaced the islands. The fatigue properties were comparable to those of the Cr-B coating, showing a substantial improvement over the uncoated material. But as discussed below, erosion resistance was inferior. This indicates that many prior art generalizations about the utility of various first and second step boron containing coatings cannot be accepted as valid in the absence of data.

Further data was gathered on the comparative characteristics of the several coatings, in order to define the unique aspects of the coating on the nickel-iron base alloy. Hardness was measured and is indicated in Table 1. It is seen that the hardness of the chromium layer is somewhat greater in the IN 901 than it is in the AMS 5616. However, at the surface, the microhardness of the combined chromium and boron layer is about the same for both ironnickel and steel materials. Hardness is highest for the Ti-B layer.

Since the principal purpose of the invention was to provide erosion protection to compressor blades, a multiplicity of erosion tests were run. These tests were conducted by impinging an airborne erosive particulate of $27\times10^{-6}$ m alumina against test panels inclined variously at 20°, 45°, 90° to the streamline. The data for the 20° impingement angle and 25° C. are representative of the best results and are presented in Table 2. It is seen that the steel and nickel-iron substrate materials are about equal in the uncoated condition. With the chromium-boron coating, the life of the AMS 5616 is increased about 4.6 times, but the life of the IN 901 is increased dramatically by more than 15 times. The Table also shows that the titanium-boron coating on IN 901 did not provide any erosion improvement. At 45° and 90° angles the AMS 5616 life was about 3 times improved while at the same angle IN 901 showed 5–10 times improvement. Thus, it can be said the Cr-B coating provides at least 5 times erosion life improvement to IN 901.

TABLE 1

Vickers Microhardness of Coating on Different Substrates

| | Substrate | |
|---|---|---|
| | AMS 5616 | IN 901 |
| Cr layer (a) | 200–370 | 660–970 |
| Cr + B layer (b) | 1050–1150 | 940–1180 |
| Ti layer | — | 610–1060 |
| Ti + B layer | — | 1140–1350 |

(a) Unboronized portion of layer 10
(b) Boronized portion 16 of layer 10

Thus, these data indicate that the microhardness data are not a measure of the resistance to particulate erosion. Obviously, it is the particular coating structure, produced by the interaction of the diffused elements with the substrate materials that is determinative. The data show that the Cr-B structure which is produced on the IN 901 is superior both in erosion resistance and fatigue resistance to the Cr-B structure which is produced on AMS 5616 and the Ti-B structure on IN 901. The photomicrographs show some of the differences between the two coatings. In addition, we made a phase analysis using x-ray diffraction of the steel and nickel-iron alloy substrates after they had been chromized. In the IN 901, a single body centered cubic chromium phase was found. In contrast, in the AMS 5616 there was by volume percent about 50 $Cr_2C$ and about 50 $M_{23}C_6$, with no evidence of pure chromium. Thus, one speculation we have is that the chromium combines with the carbon in the iron base alloy to form carbides. In contrast, the chromium in the IN 901 is more free to combine with the subsequently infiltrated boron, to form chromium borides or other compounds, whatever their nature, which are superior in properties to those formed in the AMS 5616.

TABLE 2

Relative Erosion Resistance as Measured by Time in Seconds to Achieve 0.025 mm Depth of Material Removal for Different Diffusion Coatings

| | Substrate | |
|---|---|---|
| | AMS 5616 | IN 901 |
| No coating | 24 | 20 |
| Cr + B | 110 | 330 |
| Ti + B | — | 20 |

Table 3 shows the effects of time and temperature on the thickness of the super-enriched Cr layer coating produced on the steel and nickel-iron substrates, as a function of temperature and coating cycle time. As expectable, the higher temperature causes a greater depth of penetration of the chromium in each material, for any given time. For the same parameters there is somewhat greater depth of super-enriched chromium into the nickel-iron alloy substrate than there is into the steel alloy substrate. The Cr penetration seems to reach its maximum at around 12 hrs in the nickel-iron alloy;

there is also not a great increase in subsequent period after 12 hrs for the AMS 5616.

The temperature of chromizing is dependent on the thickness of coating which is desired. Based on our work, the coating cycle should be 900°-1040° C. and the time should range from 6-24 hrs.

Since prior art work shows that the boron should not be allowed to penetrate down to the substrate where it may cause embrittlement, we limit its penetration to about 50-90% of the depth of the chromium, preferably about 75% penetration. Boron is relatively mobile and we find temperatures of 870°-935° C. and time of 6-10 hr. to be sufficient. We prefer to use the lower temperatures, to provide easier control of the depth of diffusion. However, other temperatures and times will be useable in carrying out the objects of the invention, insofar as obtaining the above mentioned depth of B diffusion.

TABLE 3

| Time-hr. | Diffused Chromium layer Thickness in $10^{-6}$ m at Different Diffusion Pack Parameters AMS 5616 | IN 901 |
|---|---|---|
| At 900° C. | | |
| 6 hr. | 5.1 | 5.1 |
| 12 | 7.6 | 12.7 |
| 24 | 10.2 | 15.2 |
| At 1040° C. | | |
| 6 hr. | 13.0 | 17.8 |
| 12 | 17.8 | 27.9 |
| 24 | 20.3 | 27.9 |

Table 4 shows the extent to which boron is diffused into chromized substrates according to the temperature which is used. It is seen that 927° C./6+ hrs produces a penetration greater than the thickness of the $13\text{-}18\times10^{-6}$ m super-enriched chromized layer on IN 901. Similarly, 871° C./10 hrs also reaches the full depth. Analogous data is presented for the AMS 5616 having a $13\text{-}15\times10^{-6}$ m chromized layer. It is seen that somewhat higher temperatures are needed to drive the boron into the chromized substrate; i.e., conversely the B is more mobile in the IN 901. The data show that a variety of temperatures and times can be used to achieve the objects of the invention.

While the pack compositions which we indicated in the beginning of this section are preferred, the compositions may be varied within the known ranges of processes and materials used in chromizing and boronizing, some of which are recited in the background. See also the disclosure and references of U.S. Pat. No. 4,184,936 to Grisik et al, hereby incorporated by reference. Of course, when cariations in pack compositions are made, the parameters used will be varied accordingly to achieve the coatings which we describe herein. Additionally, other diffusion process which provide a diffused Cr and B layer such as gas phase processes may be utilized.

TABLE 4

| Time-hr. | Diffused Boron Layer Thickness in $10^{-6}$ m at Different Diffusion Pack Parameters, for Substrates Having About $13\text{-}15\times10^{-6}$ m Diffused Cr Layer AMS 5616 | IN 901 |
|---|---|---|
| At 870° C. | | |
| 6 hr. | 2.5-5 | 5-7.6 |
| 10 | 2.5-5 | 10-13 |
| 16 | 5-7.6 | 13-18 |
| At 930° C. | | |
| 6 hr. | 5-7.6 | 10-15 |
| 10 | 10-13 | 32-38 |
| 16 | 10-13 | 38-51 |

A Cr-B coating was applied to the wrought nickel base alloy IN 718 (by weight 19 Cr, 0.9 Ti, 0.6 Al, 3 Mo, 18 Fe, 5 (Ta+Cb), balance Ni) using our preferred parameters for IN 901. But chromizing caused excessive grain growth, thereby degrading substrate fatigue properties. Thus, we did no testing and have no conclusion about the utility of our invention for predominately nickel base alloys at this point in our work. The IN 718 results do indicate the criticality of coating parameters with respect to the substrate.

Accordingly, our work has shown how iron-nickel base alloys are distinct from iron base alloys. Generally, our invention is applicable to austenitic alloys having by weight percent 25-45 Ni and 30-50 Fe. From these contents, the weight ratio of Fe to Cr will range from 2:1 to 2:3. The alloys also will contain at least 10 Cr. Included within the scope of the invention will be the exemplary alloys listed in Table 5. These exemplary alloys contain at least 1 Ti to provide for precipitation strengthening, and up to 1 Al to stabilize the strengthening precipitate. However, we do not believe Al and Ti are interactive with the Cr and B and therefore they are not influential on the results obtained.

TABLE 5

| Name | C | Mn | Si | Cr | Ni | Co | Mo | C6 | Ti | Al | B | Zr | Fe | Other |
|---|---|---|---|---|---|---|---|---|---|---|---|---|---|---|
| | NOMINAL COMPOSITION IN WEIGHT PERCENT OF IRON-NICKEL ALLOYS | | | | | | | | | | | | | |
| Discaloy | 0.04 | 0.9 | 0.8 | 13.5 | 26 | — | 2.75 | — | 1.75 | 0.10 | — | — | Bal | — |
| A286 | 0.05 | 1.40 | 0.40 | 15 | 26 | — | 1.25 | — | 2.15 | 0.2 | 0.003 | — | Bal | 0.03 V |
| Inco 901 | 0.05 | 0.4 | 0.4 | 13.5 | 42.7 | — | 6.2 | — | 2.5 | 0.2 | — | — | 34 | — |
| Inco 903 | — | — | — | — | 38 | 15 | — | 3.0 | 1.4 | 0.7 | — | — | Bal | — |
| Pyromet 860 | 0.05 | 0.25 | 0.10 | 13 | 44 | 4.0 | 6.0 | — | 3.0 | 1.0 | 0.01 | — | Bal | — |
| V57 | 0.08 max | 0.35 max | 0.75 max | 14.8 | 27 | — | 1.25 | — | 3.0 | 0.25 | 0.01 | — | Bal | 0.5 V max |
| W545 | 0.08 max | 1.5 | 0.4 | 13.5 | 26 | — | 1.5 | — | 2.85 | 0.20 | 0.08 | — | Bal | — |
| Inco 706 | 0.03 | 0.2 | 0.2 | 16 | 41.5 | — | — | 2.9 | 1.8 | 0.2 | — | — | 40 | 0.2 Cu |

Although this invention has been shown and described with respect to a preferred embodiment, it will be understood by those skilled in the art that various changes in form and detail thereof may be made without departing from the spirit and scope of the claimed invention.

We claim:

1. A wear resistant article comprised of a nicle-iron base substrate containing by weight percent 25-45 Ni, 30-50 Fe, at least 10 Cr, an other elements, wherein Co may be substituted for a portion of the Ni, having a diffusion coating of chromium and boron, the coating comprising a chromium layer having a first superenriched Cr portion near the article surface and a second enriched Cr portion adjacent thereto, the second portion having a lesser concentration of chromium than the first portion, wherein boron is detectable only in the first chromium layer portion.

2. The article of claim 1 having a resistance to particulate erosion which is at least five times better than the erosion resistance of an uncoated article and having a fatigue resistance which is at least equal to the fatigue resistance of an uncoated article.

3. The articel of claim: 1 wherein the boron is present to 50–90 percent of the depth of the first portion of the layer.

4. A wear resistant article comprised of a nickel iron base substrate consisting essentially by weight percent of 11–14 Cr, 40–45 Ni, 5–6.5 Mo, 2.6–3.1 Ti, 0.01–0.02 B, 0.02–0.08 C., balance Fe, wherein Co may be substituted for a portion of the Ni, having on its surface a diffusion coating of chromium and boron.

5. The article of claim 4 wherein the material has a high cycle fatigue strength at $10^7$ cycles of at least about 340 MPa (~50 ksi).

* * * * *